US006446639B1

(12) United States Patent
Shyu

(10) Patent No.: US 6,446,639 B1
(45) Date of Patent: Sep. 10, 2002

(54) HAIR CLIP COMBINATION HAVING A COMB DEVICE

(76) Inventor: Shyh Ming Shyu, No. 119, Lane 234, Chengbei Road, Tainan (TW), 709

( * ) Notice: Subject to any disclaimer, the term of this patent is extended or adjusted under 35 U.S.C. 154(b) by 0 days.

(21) Appl. No.: 09/920,190

(22) Filed: Aug. 2, 2001

(51) Int. Cl.[7] ..... A45D 8/12; A45D 8/20; A45D 8/22

(52) U.S. Cl. ..... 132/275; 132/277; 132/278

(58) Field of Search ..... 132/275, 276, 132/277, 278, 279, 280, 273, 213.1; D28/42, 39, 40, 41, 43

(56) References Cited

U.S. PATENT DOCUMENTS 2,897,825 A 8/1959 Wagner
2,998,015 A 8/1961 Gresham et al.
3,412,739 A 11/1968 Thatcher
5,533,533 A * 7/1996 Shing ..... 132/279
5,546,966 A * 8/1996 Lin ..... 132/279
5,694,956 A * 12/1997 Grinszpan ..... 132/275
D393,927 S * 4/1998 Chou ..... D28/42
5,758,672 A * 6/1998 Chou ..... 132/275
5,813,418 A * 9/1998 Pillars ..... 132/201
5,865,190 A * 2/1999 Butler ..... 132/208
5,896,862 A 4/1999 Hwang ..... 132/145
6,019,108 A * 2/2000 Chen ..... 132/276
6,267,119 B1 * 7/2001 Silva ..... 132/213

* cited by examiner

*Primary Examiner*—John J. Wilson
*Assistant Examiner*—Robyn Kieu Doan
(74) *Attorney, Agent, or Firm*—Charles E. Baxley

(57) ABSTRACT

A hair clip device includes a base having a handle extended from one end and a number of longitudinal comb teeth extended from the other end for hair styling purposes. A clamping member is pivotally secured to the base and has a handle extended from one end and a number of comb teeth for engaging with the hair of the user and for clamping onto the base. The clamping member has a circular or elliptical outer shape and having the comb teeth extended downward toward the base. The comb teeth of the clamping member are preferably engaged between the comb teeth of the base.

1 Claim, 6 Drawing Sheets

HAIR CLIP COMBINATION HAVING A COMB DEVICE

BACKGROUND OF THE INVENTION

1. Field of the Invention

The present invention relates to a hair clip combination, and more particularly to a hair clip combination having a comb device provided therein.

2. Description of the Prior Art

Various kinds of typical hair clip devices have been developed and used today, and comprise two clip members that may be biased for forced toward each other to clamp the hair therebetween. The clip members may each include one or more teeth extended therefrom for styling the hair. U.S. Pat. No. 2,897,825 to Wagner, and U.S. Pat. No. 2,998,015 to Gresham et al., and U.S. Pat. No. 3,412,739 to Thatcher disclose three of the typical hair clip devices. However, the teeth of the clip members may not be suitably or conveniently used for styling the hairs, but may be used for engaging with the hair and for solidly attaching the clip devices onto the hair.

U.S. Pat. No. 5,896,862 to Hwang provides a hair clip structure that has a comb concealed therein for allowing the hair clip device to be used for styling hair. However, the hair clip includes a complicated configuration for attaching or mounting the comb into the hair clip. In addition, the comb may be easily slided relative to the clip device and thus may not be easily used for styling the hair.

The Present invention has arisen to mitigate and/or obviate the afore-described disadvantages of the conventional hair clip devices.

SUMMARY OF THE INVENTION

The primary objective of the present invention is to provide a hair clip combination including a comb device disposed or attached therein for allowing the hair clip to be used for styling operations.

In accordance with one aspect of the invention, there is provided a hair clip combination comprising a base including a first end having a handle provided therein, and including a second end having a plurality of comb teeth extended therefrom for hair styling purposes, and including a middle portion, a clamping member including a middle portion pivotally secured to the middle portion of the base with a pivot shaft, and including a first end having a handle provided therein, and including a second end having a plurality of comb teeth extended therefrom, and means for biasing the second end of the clamping member toward and to engage with the second end of the base. The comb teeth of the base may be used for hair styling purposes before the clamping member is engaged or clamped onto the base.

The comb teeth of the base are preferably longitudinal and extended away from the handle of the base for hair styling purposes.

The clamping member preferably includes a rounded or circular or elliptical outer peripheral portion having an opening formed therein for weight reducing purposes or for decorative purposes.

The second end of the clamping member includes an outer peripheral portion having the comb teeth extended therefrom and extended toward the base. The comb teeth of the clamping member are preferably engaged between the comb teeth of the base or engaged alternatively relative to the comb teeth of the base for solidly engaging onto the hair of the users.

The base and the clamping member each includes a stop extended therefrom, and extended toward each other for engaging with each other and for limiting a relative clamping movement between the base and the clamping member.

The comb teeth of the clamping member may also be longitudinal and extended away from the handle of the clamping member, for allowing the comb teeth of both the base and the clamping member to be used for hair styling purposes. The longitudinal comb teeth of the clamping member each includes at least one second teeth extended therefrom and extended toward the base for further solidly engaging onto the hair of the users.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 4:
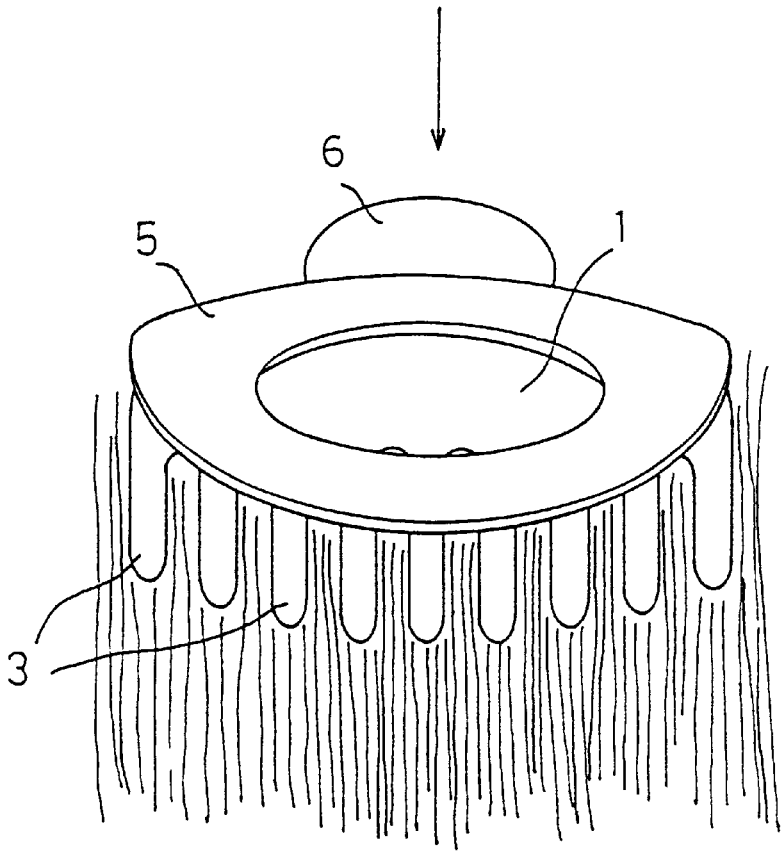
FIGS. 4, 5, 6, 7, 8 are perspective views illustrating the operation of the hair clip combination.
Figure 5:
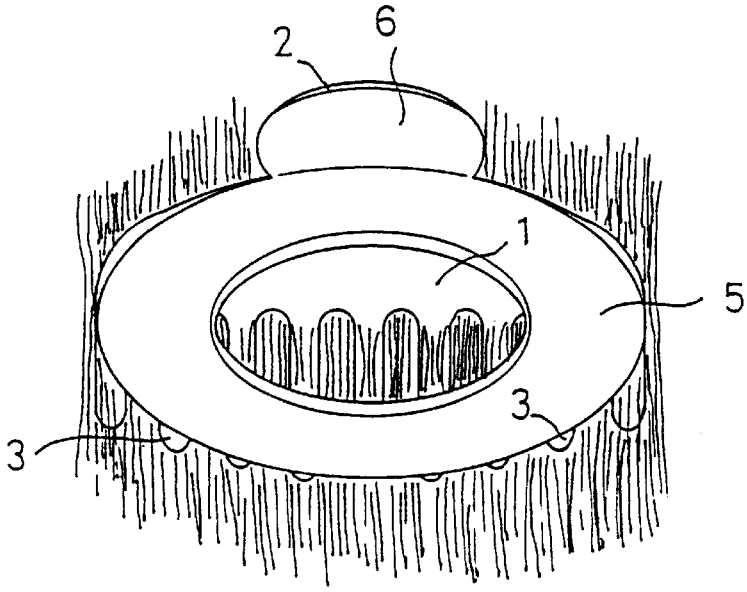
Figure 6:
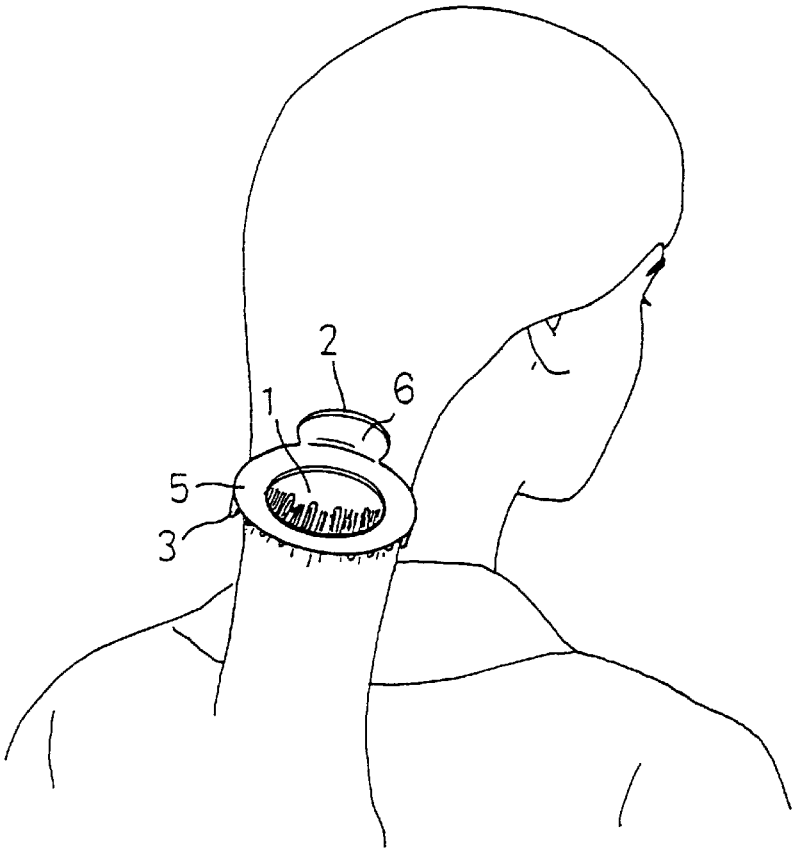
Figure 7:
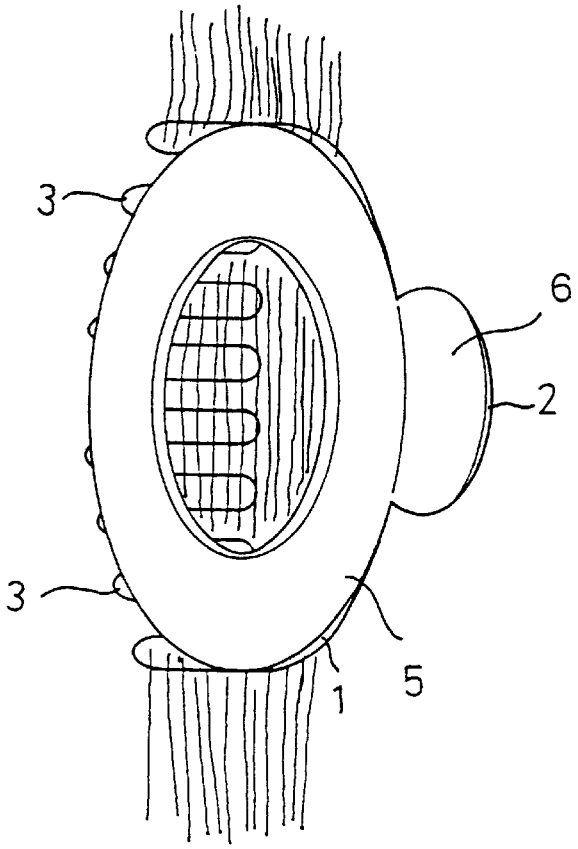
Figure 8:
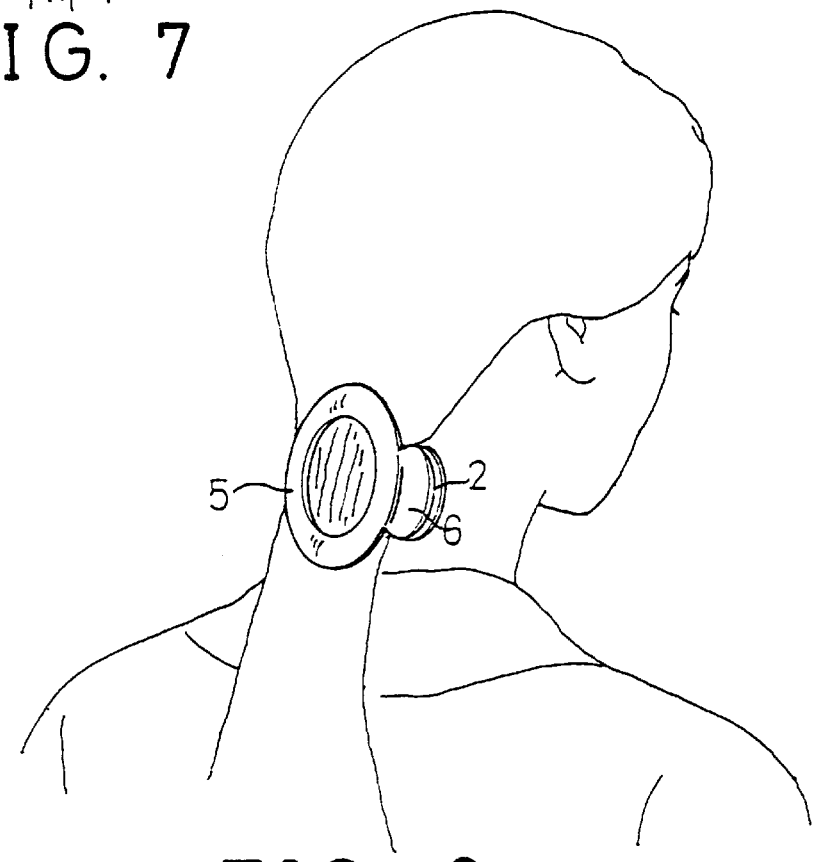

Referring to the drawings, and initially to FIGS. 1–5, a hair clip combination in accordance with the present invention comprises a base 1 including a handle 2 extended from one end thereof, such as extended rearwardly therefrom, and including a number of longitudinal comb extensions or comb teeth 3 extended from the other end, such as extended forward therefrom or extended away from the handle 2. The base 1 includes one or more seats 4 extended upward from the middle portion thereof, and preferably located closer to the handle 2. A fastener of a shaft 9 may be engaged through the seats 4. The comb teeth 3 may be used for engaging with or for styling the hair of the user (FIGS. 4–6).

A clamping member 5 also includes a handle 6 extended from one end thereof, such as extended rearwardly therefrom, and including one or more seats 8 extended downward from the middle portion thereof, and preferably located closer to the handle 6. The shaft 9 is also engaged through the seats 8 for rotatably or pivotally securing the clamping member 5 to the base 1. A spring 10 is engaged on the shaft 9 and includes two legs 11, 12 engaged with the handles 2, 6 for biasing the clamping member 5 toward or to engage with the base 1 and for clamping or engaging the hair clip combination onto the hair of the users. The handles 2, 6 are curved or extended outward or away from each other for allowing the handles 2, 6 to be forced toward each other against the spring 10.

Figure 1:
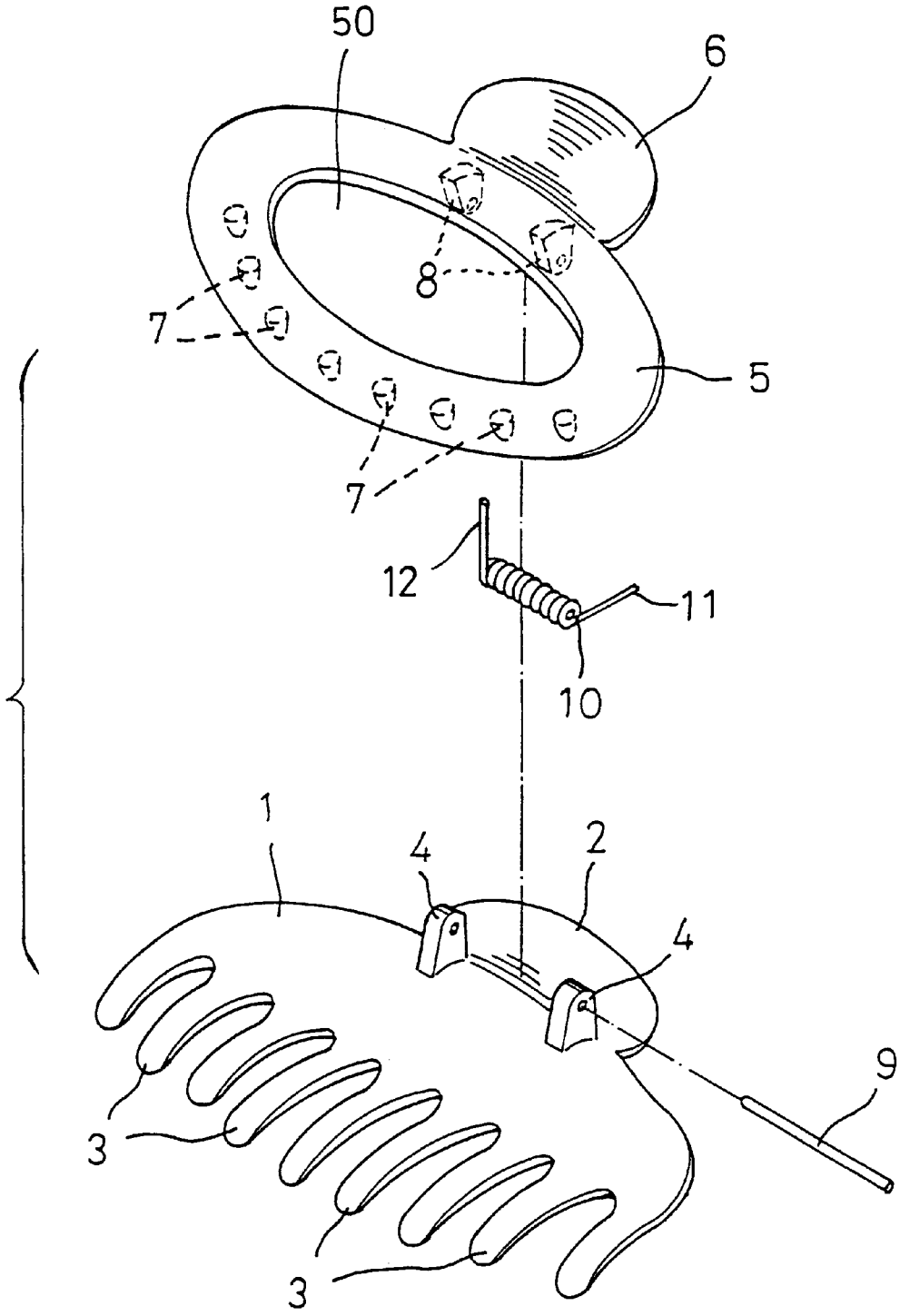
FIG. 1 is an exploded view of a hair clip combination in accordance with the present invention.
Figure 2:
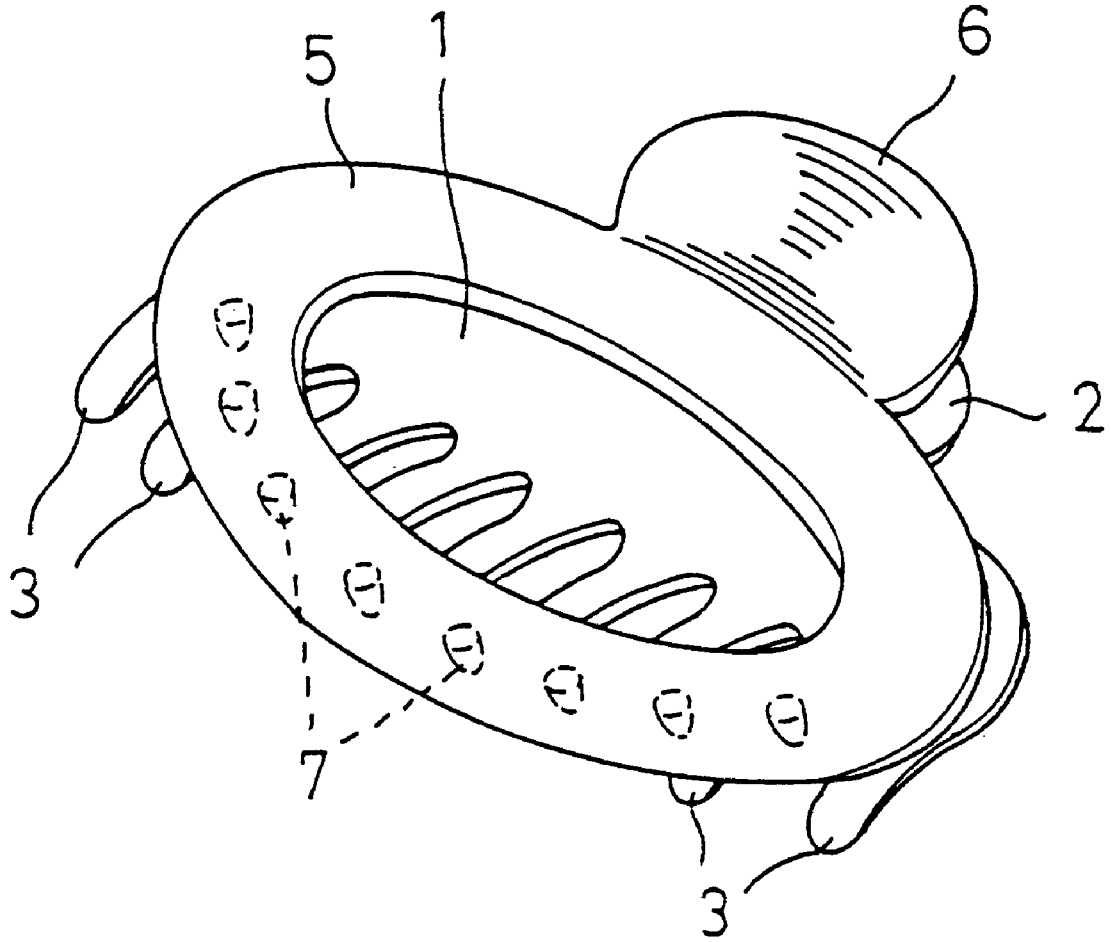
FIG. 2 is a perspective view of the hair clip combination.
Figure 3:
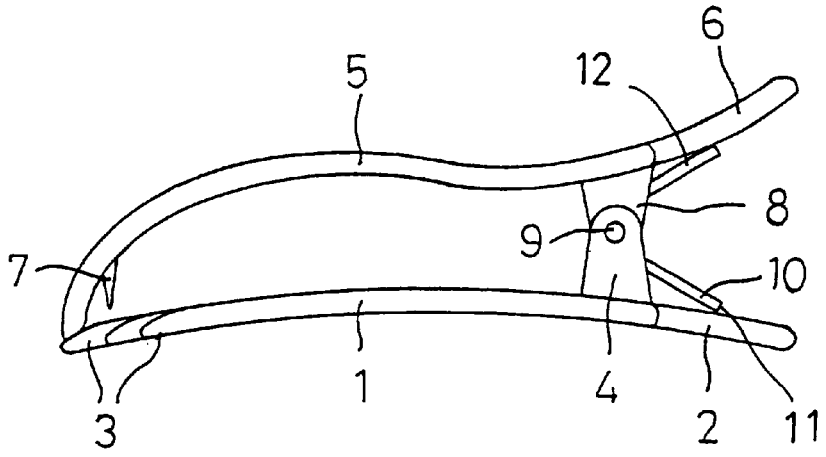
FIG. 3 is a side view of the hair clip combination.

The clamping member 5 includes a circular or an eliptical or a peripheral or a rounded outer peripheral portion having an opening 50 formed therein for weight reducing purposes or for decorative purposes, or the like; and includes a number of comb teeth 7 extended downward therefrom, particularly extended downward from the outer peripheral portion thereof, and extended toward the base 1, and preferably arranged or engaged between the comb teeth 3 of the base 1, best shown in FIG. 2, for allowing the comb teeth 3, 7 to be disposed or arranged alternatively and for allowing the clamping member 5 and the base 1 to be solidly engaged or secured onto the hair of the users (FIGS. 5–8).

Figure 9:
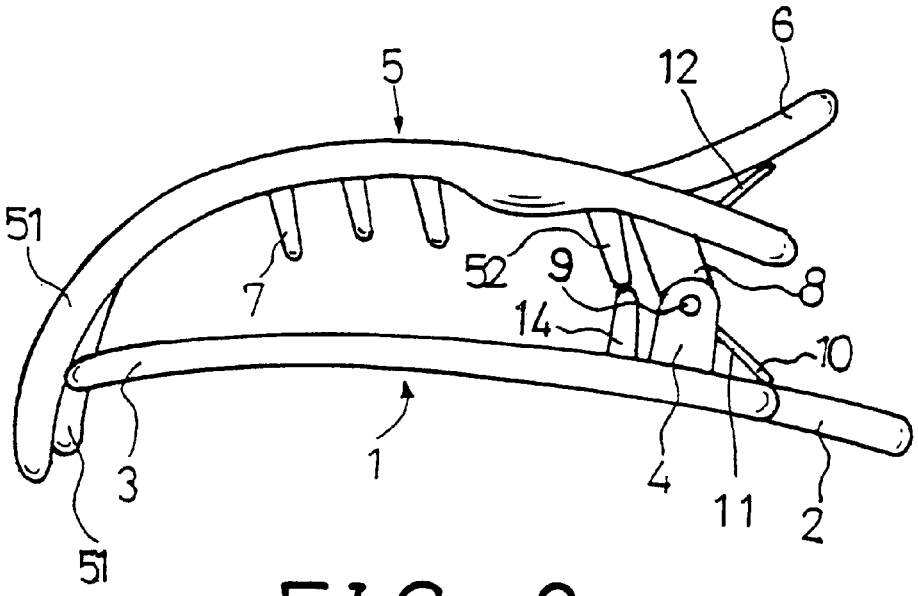
FIG. 9 is a side view showing the other embodiment of the hair clip combination.
Figure 10:
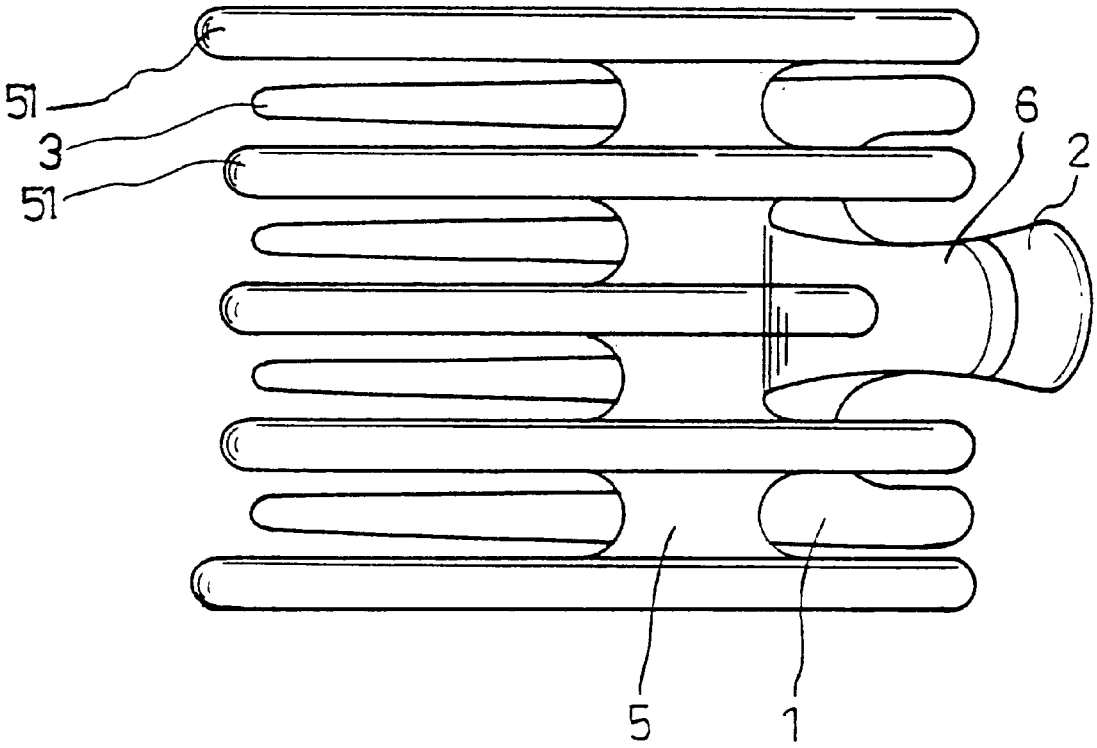
FIG. 10 is a top plan view of the hair clip combination as shown in FIG. 9.

Alternatively, as shown in FIGS. 9 and 10, the clamping member 5 may include a number of longitudinal comb extensions or comb teeth 51 extended from one end thereof, such as extended forward therefrom or extended away from the handle 6 and preferably arranged or engaged between the comb teeth 3 of the base 1, best shown in FIG. 10, for allowing the comb teeth 3, 51 to be disposed or arranged alternatively and for allowing the clamping member 5 and the base 1 to be solidly engaged or secured onto the hair of the users. The comb teeth 51 of the clamp member 5 each preferably further includes a number of comb teeth 7 extended downward therefrom and extended toward the base 1, and arranged or engaged between the comb teeth 3 of the base 1, for further solidly engaging or securing the clamping member 5 and the base 1 onto the hair of the users. As shown in FIG. 9, the base 1 and the clamping member 5 may each include one or more stops 14, 52 extended therefrom and preferably extended toward each other for engaging with each other and for limiting the relative clamping movement of the clamping member 5 onto the base 1. The comb teeth 3, 51 may both be used for hair styling purposes.

Accordingly, the hair clip combination in accordance with the present invention includes a comb device disposed or attached therein for allowing the hair clip to be used for styling operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hair clip combination comprising:

a base including a first end having a handle provided therein, and including a second end having a plurality of comb teeth extended therefrom for hair styling purposes, and including a middle portion, said comb teeth of said base being longitudinal and extended away from said handle of said base, a clamping member including a middle portion pivotally secured to said middle portion of said base with a pivot shaft, and including a first end having a handle provided therein, and including a rounded outer peripheral portion having an opening formed therein, and including a second end having a plurality of comb teeth extended therefrom and extended from said outer peripheral portion of said clamping member and extended toward said base, said comb teeth of said clamping member being engaged between said comb teeth of said base, means for biasing said second end of said clamping member toward and to engage with said second end of said base, and said base and said clamping member each including a stop extended therefrom, and extended toward each other for engaging with each other and for limiting a relative clamping movement between said base and said clamping member.

* * * * *